United States Patent [19]

Dunn et al.

[11] Patent Number: 4,838,759

[45] Date of Patent: Jun. 13, 1989

[54] CAVITATION-RESISTANT INDUCER

[75] Inventors: Charlton Dunn, Calabasas; Maria R. Subbaraman, Canoga Park, both of Calif.

[73] Assignee: Rockwell International Corporation, El Segundo, Calif.

[21] Appl. No.: 178,819

[22] Filed: Mar. 29, 1988

Related U.S. Application Data

[63] Continuation-in-part of Ser. No. 36,627, Apr. 10, 1987, abandoned.

[51] Int. Cl.[4] ..... F04D 29/68

[52] U.S. Cl. ..... 415/143; 415/199.6; 415/218.1

[58] Field of Search ..... 415/53 R, 143, 199.6, 415/215, DIG. 1, 213 C; 416/189, 191, 175, 177, 198 A, 234

[56] References Cited

U.S. PATENT DOCUMENTS

| | | | |
|---|---|---|---|
| 1,910,443 | 5/1933 | Mobley | 416/189 |
| 2,991,927 | 7/1961 | Quick | 415/215 X |
| 3,936,225 | 2/1976 | Stjernstrom | 415/215 X |
| 4,097,186 | 6/1978 | Budris | 415/199.6 X |
| 4,111,597 | 9/1978 | Grossi et al. | 415/199.6 X |

FOREIGN PATENT DOCUMENTS

| | | | |
|---|---|---|---|
| 119369 | 12/1970 | Denmark | 416/234 |
| 3012406 | 10/1981 | Fed. Rep. of Germany | 415/199.6 |
| 53-138503 | 12/1978 | Japan | 415/199.6 |
| 2041103 | 9/1980 | United Kingdom | 416/234 |
| 2064666 | 6/1981 | United Kingdom | 415/143 |

*Primary Examiner*—Robert E. Garrett
*Assistant Examiner*—Joseph M. Pitko
*Attorney, Agent, or Firm*—H. Fredrick Hamann; Harry B. Field; David C. Faulkner

[57] ABSTRACT

An improvement in an inducer for a pump wherein the inducer includes a hub, a plurality of radially extending substantially helical blades and a wall member extending about and encompassing an outer periphery of the blades. The improvement comprises forming adjacent pairs of blades and the hub to provide a substantially rectangular cross-sectional flow area which cross-sectional flow area decreases from the inlet end of the inducer to a discharge end of the inducer, resulting in increased inducer efficiency improved suction performance, reduced susceptibility to cavitation, reduced susceptibility to hub separation and reduced fabrication costs.

10 Claims, 2 Drawing Sheets

CAVITATION-RESISTANT INDUCER

STATEMENT OF GOVERNMENT INTEREST

The Government has rights in this invention pursuant to Contract (or Grant) No. DE-ATO3-83SF11901 awarded by the U.S. Department of Energy.

"This is a continuation-in-part of co-pending application Ser. No. 07/036,627 filed on Apr. 10, 1987" now abandoned.

BACKGROUND OF THE INVENTION

1. Field of the Invention

The present invention relates to axial and centrifugal pumps which utilize inducers. The present invention provides an inducer capable of operating over a wider range of flow rates with less risk of cavitation and a higher efficiency than would otherwise be possible.

2. Description of the Prior Art

In general when a pump is required to operate over a wide range of flow capacities and has an optimum rate of fluid in flow which takes place at the design duty point, the parts of the pump may undergo extensive wear resulting from cavitation whenever the pump is operated in a part-load flow region. The effects of cavitation are more pronounced in larger pumps and the wear owing to cavitation also increases with increasing rotational speed. Attempts to reduce the wear which is attributal to cavitation include limiting the interval of operation in the part load region but this is not always practical. It has also been proposed to utilize more wear-resistant material for those parts which are likely to be exposed to the effects of cavitation or to use wear-resistant inserts. These techniques, however, are not wholly effective and complicate the design of the pump.

The use of an inducer to conjunction with, for example, a centrifugal pump, has been found to be the most effective way of permitting the pump to operate over a wider range of flow rates than would otherwise be possible. There still exists, however, a need for further improvements to permit large pumps to operate over even wider ranges of flow rates without cavitation damage. This is particularly true, for example, for pumps used in a nuclear reactor powered electric utility where the flow rate through the pump must be varied widely to conform to electrical demands and further where the pump must be designed to operate for up to 20 years.

OBJECTS OF THE INVENTION

It is an object of the invention to provide an improved inducer which will operate over a wide flow range and minimize or eliminate any cavitation damage which would otherwise result from liquid flowing therethrough. It is another object of the invention to provide an improved inducer which will operate over a wider flow range without hub separation.

It is another object of the invention to provide such an improvement in a shrouded inducer.

Yet another object of the present is to provide a shrouded inducer which will operate over a wide range of flow rates and maintain a high efficiency.

Still another object of the invention is to provide such a shrouded inducer which is readily fabricable without undue cost.

SUMMARY OF THE INVENTION

The foregoing and other objects are achieved by the present invention which provides an inducer which minimizes or substantially eliminates any damage from cavitation while pumping a liquid capable of becoming a two-phase fluid and which is required to operate over a wide range of flow rates. In a more particular aspect, the present invention comprises an improvement in a shrouded inducer for use with a downstream pump or where the pump and inducer are required to operate over a wide flow range and pump a liquid capable of becoming a two-phase fluid.

Broadly, the inducer of the present invention comprises a hub rotatably mounted within a pump housing a plurality of substantially helical blades extending radially outward from the hub and a wall member extending about and encompassing an outer periphery of the substantially helical blades. The wall member, of course, could be an inner surface of the pump housing or in accordance with the preferred embodiment would comprise a shroud extending about the outer periphery and affixed to ends of the substantially helical blades. The essence of the present invention is that adjacent pairs of blades, the wall member and hub form a substantially rectangular cross-sectional flow area, the cross-sectional flow area decreasing from the inlet (suction) end of the inducer to a discharge (pressure) end. Generally, the cross-sectional flow area decreases substantially linearly. In accordance with a particularly preferred embodiment there are provided four substantially helical blades spaced equidistant about the hub and each of the blades extends approximately 180° about an outer periphery of the hub.

DESCRIPTION OF A PREFERRED EMBODIMENT

Figure 1:
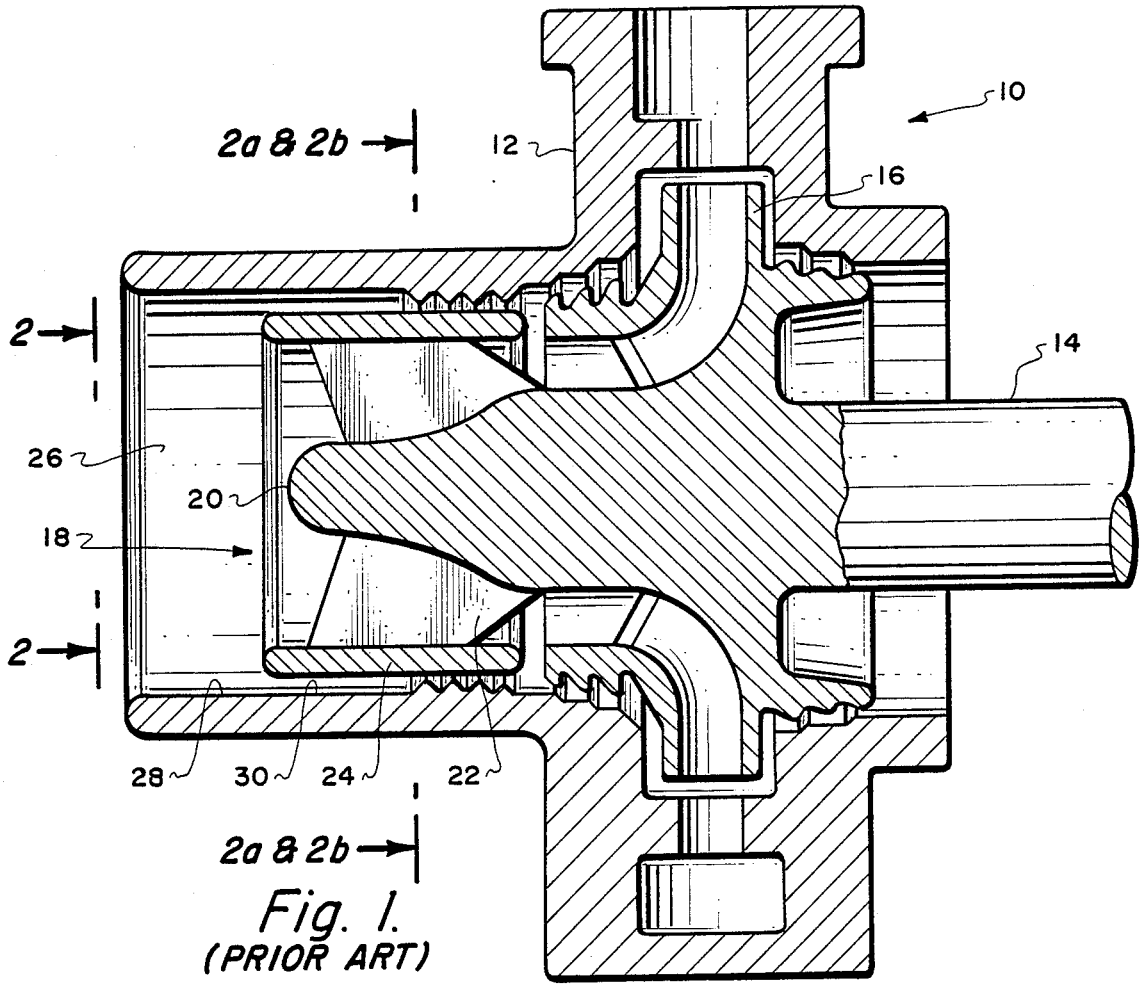
Fig. 1. (PRIOR ART)
FIG. 1 is a schematic cross-sectional side view of a centrifugal pump having a shrouded inducer.

Throughout the following description, the same elements or parts of the drawings are designated by the same reference characters. Referring to FIG. 1 therein is depicted a typical shrouded inducer-centrifugal pump assembly 10 which includes a housing 12, a drive shaft 14 extends into housing 12 and is rotatably supported by bearings not shown. A centrifugal impeller 16 located within housing is affixed to drive shaft 14 for receiving rotational forces therefrom and imparting rise in pressure to any fluid passing through housing 12. A shrouded inducer 18 is affixed to a hub end 20 of shaft 14 for increasing the pressure of incoming fluid before it enters impeller 16. Alternatively of course shrouded inducer 18 could be attached directly to impeller 16. Inducer 18 comprises at least one and preferably a plurality of inducer blades 22 which extend radially outward and terminate in a substantially cylindrical shroud member 24. As depicted shrouded inducer assembly 18 is located within a cavity 28 defined by an inner surface 30 or wall member of housing 12, which inner surface would form an outer wall extending about an outer periphery of inducer blades 22 if an unshrouded inducer were utilized.

Figure 2:
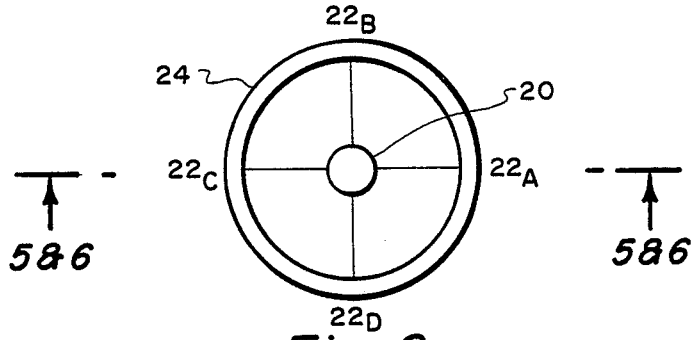
FIG. 2 is an end of the inducer of FIG. 1 taken along plane 2—2.

Referring now to FIG. 2, therein is depicted an end view of a preferred form of inducer for the practice of the present invention. Specifically, one having four equally spaced, substantially helical blades which extend approximately 180° about an outer periphery of hub end 20. As depicted, straight radial uncanted blades are shown for simplicity. The leading edge shape of the blades and the front view of the inducer would be equally applicable to a prior art inducer as well as that of the present invention, as is also the case with the unwrapped top view shown in FIG. 3. Therein, again in the interest of simplicity, the inducer blades are shown for a simple, straight, constant blade angle. The inducer of the present invention differs from the prior art designs in the shape of the flow passages and the hub contour which is more readily seen in the following figures.

Figure 2A:
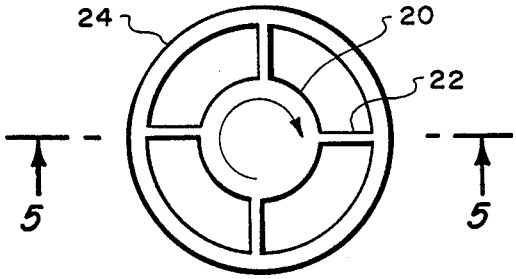
Fig. 2a. (PRIOR ART)
FIG. 2*a* is a sectional view taken at 2*a*—2*a* of FIG. 1.
Figure 2B:
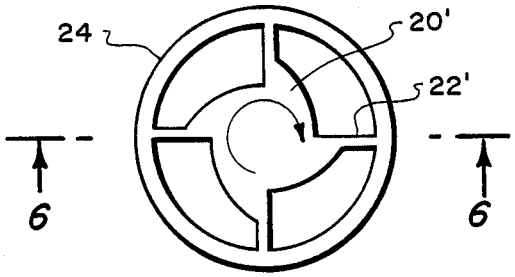
FIG. 2*b* is a sectional view of an inducer according to the present invention if taken along 2*b*—2*b* of FIG. 1.

The difference between the present invention and the prior art is shown in part in FIGS. 2*a* and 2*b*. FIG. 2*a* shows a radial cross-section midway along the inducer axis of rotation (FIG. 1, 2*a*—2*a*) which is typical to all prior art shrouded inducers with radial blades, characterized by an axisymmetric hub shape. FIG. 2*b* shows a corresponding radial cross-section (FIG. 1, 2*b*—2*b*) for the inducer of the present invention. As shown in FIG. 2*b*, to maintain the design of the flow passages, the hub is ratchet-shaped and not axisymmetric.

Figure 3:
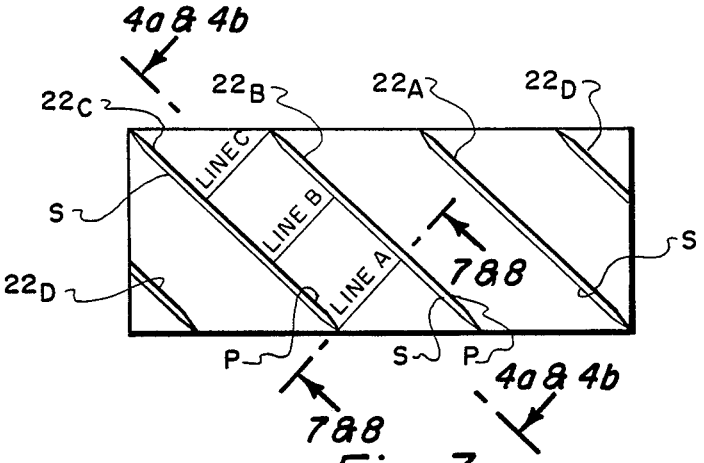
FIG. 3 is an unwrapped view of the inducer.
Figure 4A:
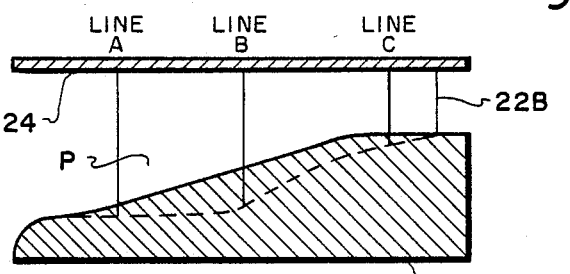
Fig. 4a. (PRIOR ART)
FIGS. 4*a* and 4*b* are sectional views of the prior art and the present invention respectively, taken along plane 4*a*—4*a* and 4*b*—4*b*, respectively, of FIG. 3.
Figure 4B:
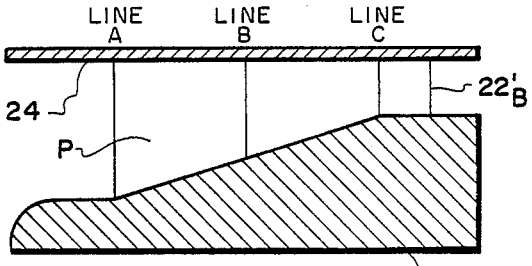

Referring now to FIGS. 4*a* and 4*b* therein are depicted cross sections of fluid passageway along line 4*b*—4*b* in FIG. 3. This cross-section is parallel to the blades (i.e. along the middle of the flow passage halfway between adjacent blades. The hub profiles of prior art inducers (see FIG. 4*a*) are higher degree polynomials, with a different profile at each position across the width of the passage between blades as indicated by the phantom line shown in FIG. 4*a*. The hub profile of the present invention in the unwrapped section (FIG. 4*b*) is a constant ramp across the width of the passage between blades, with radius blends to short-length constant-height sections beyond the flow passage; i.e. outside the region between lines A and C.) of the inducer constructed in accordance with the present invention. It will be seen that the height of the blade and passage diminishes in a substantially linear fashion in the direction of flow. Further, this same profile would apply for any location of the cross-section within the passageway between the blade pressure side of one blade and an adjacent suction side of another blade in an inducer according to the present invention. It is a key aspect of the present invention that the blade height reduction along the flow length is basically linear with smooth transitions near the passage entrance and exit at a selected hub diameter. This cross-section is constant from blade to blade in constrast to all prior art inducers. The distinction between the prior art and the current invention is best seen and illustrated in FIGS. 5 and 7 (prior art) and FIGS. 6 and 8 (current invention).

Figure 5:
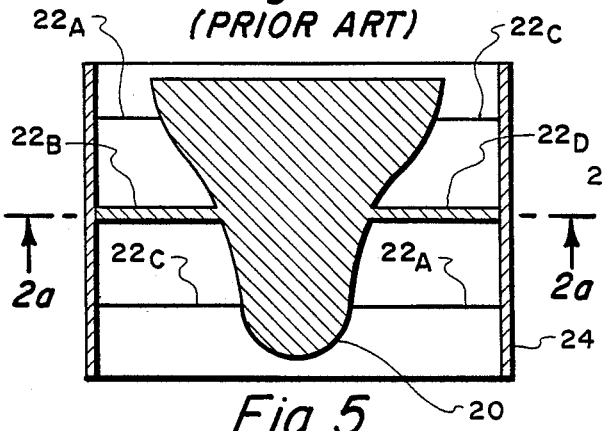
Fig. 5. (PRIOR ART)
FIGS. 5 and 6 are section views of the inducer taken along planes 5—5 of FIG. 2 and 6—6 of FIG. 2*b* showing a cross-section of an inducer constructed in accordance with the prior art and the present invention respectively.
Figure 6:
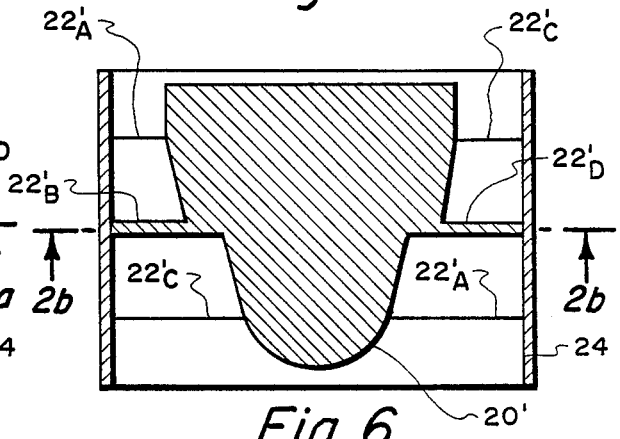
Figure 7:
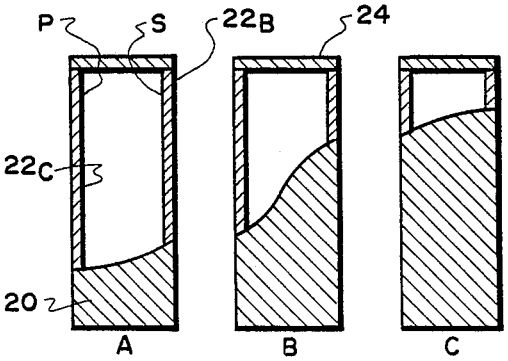
Fig. 7. (PRIOR ART)
FIGS. 7 and 8 are views taken along plane 7 & 8—7 & 8 of FIG. 3 at lines A, B and C showing the fluid flow path through an inducer as contrasted with the prior art and the present invention respectively.

It will be noted that the prior art inducer utilized as axisymetric hub as shown in FIG. 5. This resulted in a fluid passageway cross-section which is irregular with a sharply reduced passage width between the blade pressure side (P) and the hub, and a suction side passage height shorter than the pressure side, as shown in FIG. 7. The prior art inducer cross-section is along a meridional or radial plane passing through the axis of rotation of the inducer, i.e. an axisymmetric hub contour with the flow passage "wrapped" around that hub contour.

Figure 8:
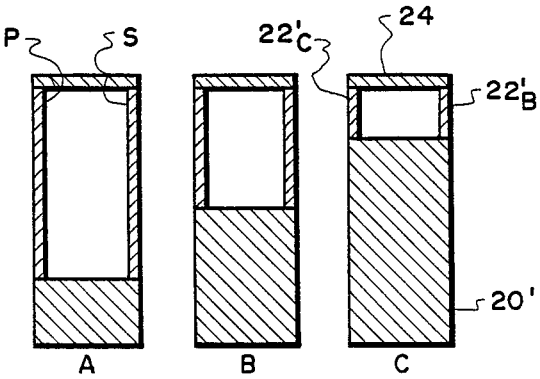

As previously noted, the inducer of the present invention (see FIG. 2*b*) utilizes a somewhat irregular or "ratchet shaped" hub. This hub shape will, of course, result in somewhat higher stress levels compared to the axisymetric hub of the comparable prior art inducer. This disadvantage, however, is offset by the advantages gained by the uniform fluid passageway. Referring to FIG. 8, it is seen that the passageway of an inducer constructed in accordance with the present invention has a rectangular-shaped cross-section formed by the ratchet-shaped hub, blades and a wall 30 of housing 12, or of the shroud wall 24 in a shrouded inducer, with suction and pressure sides of the blades of equal height. Thus, fluid passing therethrough travels in a substantially axial direction with minimal cross-currents (secondary flow) such as would be experienced with the prior art inducers. It is this uniformly diminishing cross-sectional flow area as indicated by FIG. 4*b* that permits the inducer of the present invention to operate over a wider range of flow rates without cavitation than would otherwise be possible.

The increase in inducer efficiency and suction performance of the present inducer is best understood with reference to a simple efficiency calculation. More particularly, wherein secondary flow is defined as the difference between the actual flow and an idealized axisymetrical flow, supporting calculations which qualitatively evaluate the advantage of the present invention can be expressed by the following empirical relationship:

$$C=[0.1178.E^2]/[A.R.(1-0.2/A.R.)^3] \quad (1)$$

where

E = turning angle of the cascade

A.R. = passage aspect ratio (passage height/blade spacing)

From Eq. 1 it can be shown that the energy loss coefficient C. is roughly inversely proportional to the passage aspect ratio, i.e.:

$$C \sim 1/A.R. = \text{blade spacing/passage height} \quad (2)$$

The highest losses are associated with the boundary layer separation on the blade suction side. Applying Eq. 1 locally in the suction side region the advantage of the present inducer becomes apparent. Compared to the conventional inducer the passage height along the suction side of the blade (S, FIGS. 7 and 8) is greater at the same blade spacing, resulting in reduction of the association energy loss coefficient C in this critical region (Eq. 2). Since the losses are dominated by the effects along the suction side, the result will be the reduction of the overall secondary flow loss and increase of the inducer efficiency for the inducer of the present invention.

For given head and flow requirements a pump of highest possible specific speed would be smallest, lightest and most economical. Suction performance is most often the limiting factor in this respect. An object of the present invention is to improve suction performance. Improved suction performance can, in general, be obtained by keeping the static pressure in the inducer inlet region high through opening up the fluid passage area (Section Line A between blades $22_B$ and $22_C$, FIG. 7 vs blades $22'_B$ and $22'_C$ in FIG. 8).

The rectangular throat shape, compared to the conventional passage, has a larger area in the blade suction side region—where the cavitation susceptible, low pressure, high velocity flow normally occurs. This local increase in the flow passage area leads to a local slow down of fluid velocity and a static pressure increase - which in turn leads directly to improved suction performance. The blade height on the pressure side (P) is the same for both channels and is set by the hub inlet and blade tip diameters. An important advantage of the rectangular passage design is that it results in reduced pressure gradients along the flow passage by increasing the hub radius more gradually and uniformly, thus eliminating or reducing the problem of flow separation at the hub, common in present art inducers as the flow is reduced somewhat below design flow.

One other important advantage of the rectangular passage design is that it has a lower ratio of wetted perimeter to flow are (increased hydraulic diameter) and thus, compared to prior art inducers, it will have reduced friction and boundary layer blockage and losses, leading to increased overall efficiency.

Another advantage of the inducer of the present invention is that it is more readily fabricated at a lesser cost than those of the prior art. Specifically, in the case of fully-machined, integral-shroud inducers, the fluid passage machining is usually performed from both the inlet and discharge ends of the passage. The rectangular shape of the passageway of an inducer in accordance with the present invention allows use of larger cutters, thus significantly reducing machining time and cost. The rectangular shape also simplifies the electrode shape and the forming operations in fabrication, for example, by EDM.

Although the above improvements and descriptions have been related to a shrouded inducer, they are equally applicable to the more conventional unshrouded inducer with regard to the advantages of 2-D passage design.

It will be apparent that many modifications and variations of the present invention are possible in light of the above teachings. It is to be understood, therefore, that within the scope of the appended claims, the invention may be practiced otherwise than as specifically described.

What is claimed and desired to be secured by Letters Patent of the United States is:

1. An inducer for a pump including a wall member wherein said inducer and pump are required to pump a liquid capable of becoming a two-phase fluid and operate over a wide range of flow rates, the improvement in the inducer comprising:

(a) a ratchet-shaped hub;

(b) a plurality of blades attached to said hub and having suction and pressure sides wherein the suction and pressure sides of each blade are of equal heights; and (c) a flow passage having a rectangular-shaped cross-section formed by the ratchet-shaped hub, at least two blades each adjacent one to the other, and the wall member.

2. The inducer of claim 1 wherein said cross-sectional flow area decreases linearly.

3. The inducer of claim 1 wherein there are at least two substantially helical blades spaced equidistant about said hub.

4. The inducer of claim 1 wherein each of said blades extends approximately 180° about an outer periphery of said hub.

5. The inducer of claim 1 wherein there are four substantially helical blades spaced equidistant about said hub.

6. The inducer of claim 5 wherein each of said blades extends approximately 180° about an outer periphery of said hub.

7. In a downstream pump having a wall member and including a shrouded inducer, the improvement in the inducer comprising:

(a) a ratchet-shaped hub;

(b) a plurality of blades attached to said hub and having suction and pressure sides wherein the suction and pressure sides of each blade are of equal heights;

(c) a cylindrical shrouded encircling and affixed to said blade; and (d) a flow passage having a rectangular shape formed by the ratchet-shaped hub, two blades each adjacent one to the other, and said shroud, wherein said flow passage decreases in cross-sectional area from an inlet end to a discharge end of said shrouded inducer.

8. The shrouded inducer of claim 7 wherein said cross-sectional flow area decreases linearly.

9. The shrouded inducer of claim 7 wherein there are four substantially helical blades spaced equidistant about said hub.

10. The shrouded inducer of claim 7 wherein each of said blades extends approximately 180° about an outer periphery of said hub.

* * * * *